US009168713B2

(12) United States Patent
Rauwolf et al.

(10) Patent No.: US 9,168,713 B2
(45) Date of Patent: Oct. 27, 2015

(54) MACHINE PRESS

(71) Applicant: HOERBIGER AUTOMATISIERUNGSTECHNIK HOLDING GMBH, Altenstadt (DE)

(72) Inventors: Martin Rauwolf, Schongau (DE); Bernhard Russ, Peiting (DE); Roland Thurner, Schwabsoien (DE); Ilker Oezcanoglu, Kaufbeuren (DE)

(73) Assignee: Hoerbiger Automatisierungstechnik Holding GmbH, Altenstadt (DE)

( * ) Notice: Subject to any disclaimer, the term of this patent is extended or adjusted under 35 U.S.C. 154(b) by 0 days.

(21) Appl. No.: 14/516,241

(22) Filed: Oct. 16, 2014

(65) Prior Publication Data

US 2015/0033963 A1 Feb. 5, 2015

Related U.S. Application Data

(63) Continuation of application No. PCT/EP2013/000293, filed on Jan. 31, 2013.

(30) Foreign Application Priority Data

Apr. 17, 2012 (DE) ..... 10 2012 007 511
Jul. 30, 2012 (DE) ..... 10 2012 015 118

(51) Int. Cl.
*B30B 15/16* (2006.01)
*B30B 15/18* (2006.01)
(Continued)

(52) U.S. Cl.
CPC ..... *B30B 15/166* (2013.01); *B30B 1/32* (2013.01); *B30B 15/0052* (2013.01); *B30B 15/16* (2013.01); *B30B 15/24* (2013.01)

(58) Field of Classification Search
CPC ..... B30B 1/32; B30B 1/323; B30B 15/16; B30B 15/161; B30B 16/163; B30B 15/166; B30B 15/24; B30B 15/0052; B21D 5/02; B21J 9/12; B21J 9/20
USPC ..... 100/43, 48, 269.01, 269.03, 269.05, 100/269.14, 269.18, 269.06; 72/453.02, 72/453.06, 453.07, 453.08, 453.18, 16.9, 72/20.1, 21.4
See application file for complete search history.

(56) References Cited

U.S. PATENT DOCUMENTS 3,691,946 A * 9/1972 Ando ..... 100/269.05
5,568,766 A * 10/1996 Otremba et al. ..... 100/35
(Continued)

FOREIGN PATENT DOCUMENTS

DE 102009052531 A1 5/2011
DE 102010012126 A1 9/2011
(Continued)

OTHER PUBLICATIONS

International Search report for corresponding PCT Application No. PCT/EP2013/000293, mailed May 6, 2013.
(Continued)

*Primary Examiner* — Jimmy T Nguyen
(74) *Attorney, Agent, or Firm* — Myers Wolin, LLC

(57) ABSTRACT

The hydraulic drive system of a machine press comprises at least two independent hydraulic drive units. In each of said hydraulic drive units at least one hydraulic cylinder, which is connected via valves and a main pressure line under supply pressure to a pump driven by a motor, raises and lowers the upper tool carrier. The rotational speed of the motor is adjustable via the numeric machine control, in which a rotational speed profile defined across the work cycle is stored. Furthermore, a pressure-limiting unit limiting the level of the supply pressure is provided, which at least during a part of the work cycle limits the supply pressure to the lower pressure of a pressure profile defined across the work cycle and stored in the numeric machine control and the actual load pressure increased by an extra amount at the at least one hydraulic cylinder.

14 Claims, 3 Drawing Sheets

(51) Int. Cl.

| | |
|---|---|
| ***B30B 1/32*** | (2006.01) |
| ***B30B 15/24*** | (2006.01) |
| ***B30B 15/00*** | (2006.01) |

(56) References Cited

U.S. PATENT DOCUMENTS

| | | | | |
|---|---|---|---|---|
| 6,145,307 | A * | 11/2000 | Dantlgraber | 60/327 |
| 6,240,758 | B1 * | 6/2001 | Nagakura | 72/20.1 |
| 2003/0084794 | A1 * | 5/2003 | Koyama | 100/269.01 |
| 2010/0212521 | A1 * | 8/2010 | Resch et al. | 100/269.14 |

FOREIGN PATENT DOCUMENTS

| | | | |
|---|---|---|---|
| EP | 0231735 | A1 | 8/1987 |
| EP | 0692327 | A1 | 1/1996 |
| EP | 2431166 | A1 | 3/2012 |

OTHER PUBLICATIONS

Translated International Preliminary Report on Patentability for corresponding PCT Application No. PCT/EP2013/000293, dated Apr. 16, 2014.

* cited by examiner

MACHINE PRESS

CROSS REFERENCE TO RELATED APPLICATIONS

This application is a continuation under 35 U.S.C. §120 of International Application PCT/EP2013/000293, filed Jan. 31, 2013, which claims priority to both German Application 10 2012 007 511.1, filed Apr. 17, 2012, and German Application 10 2012 015 118.7, filed Jul. 30, 2012, the contents of each of which are incorporated by reference herein.

FIELD OF THE INVENTION

The present invention relates to a machine press having a machine framework, a lower tool support (preferably disposed on the machine framework in locally fixed manner), an upper tool support, which can be moved linearly up and down relative to the lower tool support, by means of a hydraulic drive system, by an operating stroke, and a numeric machine control.

BACKGROUND

Machine presses of the aforementioned type are available in the state of the art, in various embodiments. For example (see EP 231735 A1), machine presses are already known in which the hydraulic drive system has two piston/cylinder units, by means of which the upper tool support is moved, and a single motor/pump unit (hydraulic assembly) that jointly supplies the two piston/cylinder units with hydraulic fluid. In this connection, application of fluid to the two piston/cylinder units is controlled by way of valves that can be activated by the machine control.

Furthermore, machine presses having two piston/cylinder units that jointly serve for movement of the upper tool support are known, in which the hydraulic drive system furthermore has two separate motor/pump units, which each supply only one assigned piston/cylinder unit with hydraulic fluid. The speed of raising and lowering the upper tool support is typically dependent on the motor speed of rotation, whereby a. switch between raising and lowering takes place by means of a reversal of the direction of rotation of the pump (reversing pump).

Another machine press having two cylinder/piston units, each supplied by a separate motor/pump unit and jointly serving for movement of the movement of the upper tool support, is known from EP 692327 A1. In the interests of improved efficiency, here an additional pressure storage system is provided. This system comprises two additional pump/motor units, each assigned to a motor/pump unit, which can be mechanically coupled with these, and a pressure storage unit. In phases of low power demand of the cylinder/piston units, the pressure storage unit is merely charged by means of the motor/pump unit operated in pump mode, whereas in phases of great power demand of the cylinder/piston units, i.e. at peak load, the motor/pump units—with fluid applied from the pressure storage unit—are operated in motor mode, in order to support the primary motor/pump units in this way.

SUMMARY

The present invention is based on the task of making available a machine press of the type stated initially, which is characterized by very great energy efficiency, at comparatively low production costs and a compact structure of the hydraulic drive system.

This stated task is accomplished, according to the invention, by means of a machine press of the type indicated initially, which is furthermore characterized by the combination of functionally, synergistically interacting characteristics indicated in claim 1. Accordingly, the upper tool support of a machine press, which can particularly be a press brake, is moved linearly up and down using at least two hydraulic cylinders comprised by the hydraulic drive system. In each instance, at least one hydraulic cylinder, which is preferably structured as a dual-action differential cylinder, in each instance, is part of a separate hydraulic drive unit, so that the hydraulic drive system comprises at least two separate hydraulic drive units, each having its own motor/pump unit. Each of the motor/pump units draws hydraulic fluid from a tank and supplies it to a main pressure line. The hydraulic fluid is passed from this line, by way of valves that are preferably structured as proportional valves, to the at least one hydraulic cylinder of the hydraulic drive unit, in each instance, in controlled manner, in order to lift or lower the upper tool support—depending on the pressure application to the lifting work space or the lowering work space—whereby rapid lowering of the upper tool support can also take place solely under its own weight, i.e. without pressure application to the lowering work space, by means of a corresponding hydraulic circuit (see below).

A speed-of-rotation profile and a pressure profile are stored in the memory of the numeric machine control of the machine press. Both are defined by way of a work cycle of the machine press. The numeric machine control acts on the at least two hydraulic drive units, which are (hydraulically) independent of one another, i.e. on the motor of the motor/pump unit, in each instance, and on different valves, to control them.

For one thing, the numeric machine control controls the speed of rotation of the motor of the hydraulic drive unit, in each instance, using the speed-of-rotation profile. Thus, the motor drives the pumps at the speed of rotation predetermined by the numeric machine control, as a function of the phase, which speed is dimensioned in such a manner that the volume stream of hydraulic fluid—if necessary plus a safety margin (see below)—required for the desired movement of the upper tool support is made available. The pump, in each instance, draws in an amount of hydraulic fluid corresponding to the speed of rotation, as a function of its displacement volume, from he tank, and passes it to the main pressure line.

For another thing, the numeric machine control predetermines a maximally prevailing supply pressure in the main pressure line, in each instance, for the at least two hydraulic drive units, as a function of the phase, in each instance, on the basis of the pressure profile. This phase-dependent maximal pressure is typically oriented according to the maximal pressure required in the work phase, in each instance, for a specific pressing procedure, to which the pressure profile in question is tailored, if necessary increased by a safety margin (see below), whereby setting the maximal pressure can supplementary also fulfill a safety function, which protects the hydraulic drive unit from excessive pressure. Furthermore, it is provided, according to the invention, that in each of the at least two hydraulic drive units, the pressure-limiting unit, in each instance, individually lowers the supply pressure prevailing in the main pressure line in question, at least during a part of the work cycle (particularly in the phase of what is called "force-pressing"; see below) even below the phase-dependent maximal pressure predetermined by means of the pressure profile, specifically as a function of the demand. In this sense, the supply pressure is individually limited, by means of the pressure-limiting unit, in each instance, for each of the hydraulic drive units, at least part of the time, to the smaller pressure of the maximal pressure predetermined by the pressure profile and the actual load pressure existing at the at least one hydraulic cylinder, plus a margin, whereby the decisive load pressure is applied to the lowering work space, if the decisive time period of the load-dependent pressure limiting extends from the lowering phase into the lifting phase, depending on the work phase, or to the lifting work space of the at least one hydraulic cylinder. This further limiting allows adaptation of the supply pressure, which is limited upward by means of the numeric machine control, on the basis of prognosticated required pressure values, to the actual demand-dependent and operation-dependent load pressure. By means of the system structure, with at least two hydraulic drive units that are independent of one another, the actual supply pressure in each of the at least two hydraulic drive units can therefore advantageously be set individually, to the load pressure of the hydraulic drive unit in question, in each instance. For typical practical applications of the machine press, this is an important aspect with regard to energy efficiency; this is because in the case of asymmetrical press tasks, in which the different hydraulic cylinders of the hydraulic drive system must make different forces available (for example in the case of placement of the work piece outside the center, in a mono-press, or centered placement of the work piece in a tandem press), hydraulic power is made available in each of the motor/pump units only on the order actually required (taking a safety margin into consideration). In particular, the identical supply pressure is not made available for all the hydraulic cylinders, as a function of load, with reference to the greatest load of all the hydraulic cylinders of the entire hydraulic drive system—or actually completely independent of the actual load. The combination, as explained above, of synergistically interacting characteristics with regard to conveyed amounts that are profile-controlled on the supply side, and pressure levels that are profile-controlled and set as a function of load, makes a significant contribution to tremendously increasing the energy efficiency of the machine press, with moderate use of means. As a result of the increased energy efficiency, because significantly less waste heat must be conducted away, in total, the tank volumes can furthermore be designed to be less—in the sense of the most compact drive system possible—and/or additional measures for cooling the hydraulic fluid can be avoided in these sense of the least possible technical effort.

As compared with the state of the art explained in the introduction, it should accordingly be stated as particular advantages of the machine press according to the invention that this press can be operated particularly efficiently, with little construction effort, whereby furthermore, particularly with reference to the hydraulic cylinders provided, a modular structure is made possible. And even as compared with known machine presses having load-sensing functionality, in which the supply pressure made available by means of a common motor/pump unit that supplies all the hydraulic cylinders is coordinated, as a function of load, with the highest load pressure that prevails in the system, significant energy advantages occur, as has been explained. In addition, in order to guarantee the load-sensing function in known machine presses, piston/cylinder units equipped with pressure sensors, which are expensive special productions, must be used. The installation of simple cylinders of different manufacture, in the sense of a modular structure, is not possible in such systems. In this regard, the rather slight effort in terms of production technology in the machine press according to the invention should also be emphasized. In this regard, it proves to be advantageous that great effort, as it occurs when using regulatable asynchronous motors with feedback, on the basis of the complicated integration into the hydraulic system that is required, can be avoided in the implementation of the present invention.

In a preferred embodiment, the pressure-limiting unit has a pressure limiter that can be controlled by the numeric machine control, and a separate, hydraulically mechanical pressure compensator switched in parallel with it, in terms of flow technology. By means of the numeric machine control, a pressure is set at the pressure limiter, as a function of the phase, which predetermines the maximal pressure that occurs in the main pressure line, as a function of the phase. The pressure compensator takes over the load-dependent regulation of the supply pressure, in each instance, to a pressure level that lies more or less below the phase-dependent maximal pressure—as a function of the actual load at the hydraulic cylinder, in each instance. The latter level preferably results from the actual current load pressure plus a margin, in each instance. In the case of such an embodiment, it is particularly advantageous if the load pressure at the at least one hydraulic cylinder of each hydraulic drive unit is tapped by means of a cost-advantageous shuttle valve and passed to the pressure compensator, i.e. to a control input of the pressure compensator, whereby the two inputs of the shuttle valve are connected with the lifting work space and the lowering work space, thereby applying the higher pressure of those that prevail in the two said work spaces to the control input of the pressure compensator. This can be practical, for reasons of failure safety, even if the pressure compensator becomes active, as intended, only during force-pressing, by means of separate measures (see below).

Furthermore, it is advantageous if a pilot valve that can be activated by the machine control precedes a second control input of the pressure compensator, in terms of flow technology, in such a manner that—depending on the position of the pilot valve—either the supply pressure or the tank pressure is applied to the second control input of the pressure compensator. In this way, it can be brought about, in targeted manner, that the pressure compensator is active only part of the time, so that the pressure compensator can be put out of operation, particularly during those operating phases of the machine press in which it would have a detrimental effect on the operating behavior (for example due to hydraulic vibration effects and/or resonance effects). If it has been ensured in this manner, i.e. by means of influencing the machine control, that the pressure compensator is active only during lowering, particularly force-lowering, the shuttle valve explained above loses its importance. Preferably, the said pilot valve can have a further function within the hydraulic drive unit in question, for example control of a controllable feeder valve in such a machine press, assigned to the lowering work space of the hydraulic cylinder in question, which function is designed for rapid lowering that takes place solely by means of the inherent weight of the upper tool support.

In a further alternative preferred embodiment, the pressure-limiting unit, in each instance, comprises an electronic pressure compensator that can be controlled electronically by means of the numeric machine control, integrated into a structural unit, which compensator also has a pressure limiter that can be adjusted by the machine control, whereby superimposition of the two functionalities, in terms of control technology, takes place. Here, combining the pressure compensator and the pressure limiter in a compact component is advantageous.

Various preferred further developments and other advantageous aspects of the invention are evident from the following description and explanation of an exemplary embodiment of the invention, and from the dependent claims, according to which an open tank in particular, which stands under atmospheric pressure, is particularly advantageous —for the method of functioning of the machine press according to the invention—and—from cost aspects—the use of a pump having a constant displacement volume, a conveying direction, and a direction of rotation and/or frequency-regulated asynchronous motors without feedback, in each instance, is particularly advantageous. Furthermore, those embodiments are particularly practical, in which

- the work cycle, for which the speed-of-rotation profile and the pressure profile predetermine the speed of rotation of the motor or the maximal supply pressure, comprises at least the phases of rapid lowering, force-lowering, and lifting of the upper tool support,
- the motor does not rotate according to the speed-of-rotation profile in the phase of rapid lowering of the upper tool support,
- according to the speed-of-rotation profile, the speed of rotation of the motor during the phase of lifting of the upper tool support exceeds the speed of rotation of the motor during the phase of force-lowering,
- the numeric control comprises an input unit at which at least the speeds of rotation of the speed-of-rotation profile and the pressures of the pressure profile can be input, and/or
- each hydraulic drive unit has precisely one hydraulic cylinder structured as a differential cylinder, whereby ideally, the differential cylinder has a surface area ratio of the lifting work space to the lowering work space of less than 0.1.

BRIEF DESCRIPTION OF THE DRAWINGS

The invention will be explained in greater detail below, using an exemplary embodiment illustrated in the drawing. This shows.

DETAILED DESCRIPTION OF THE PREFERRED EMBODIMENTS

Figure 1:
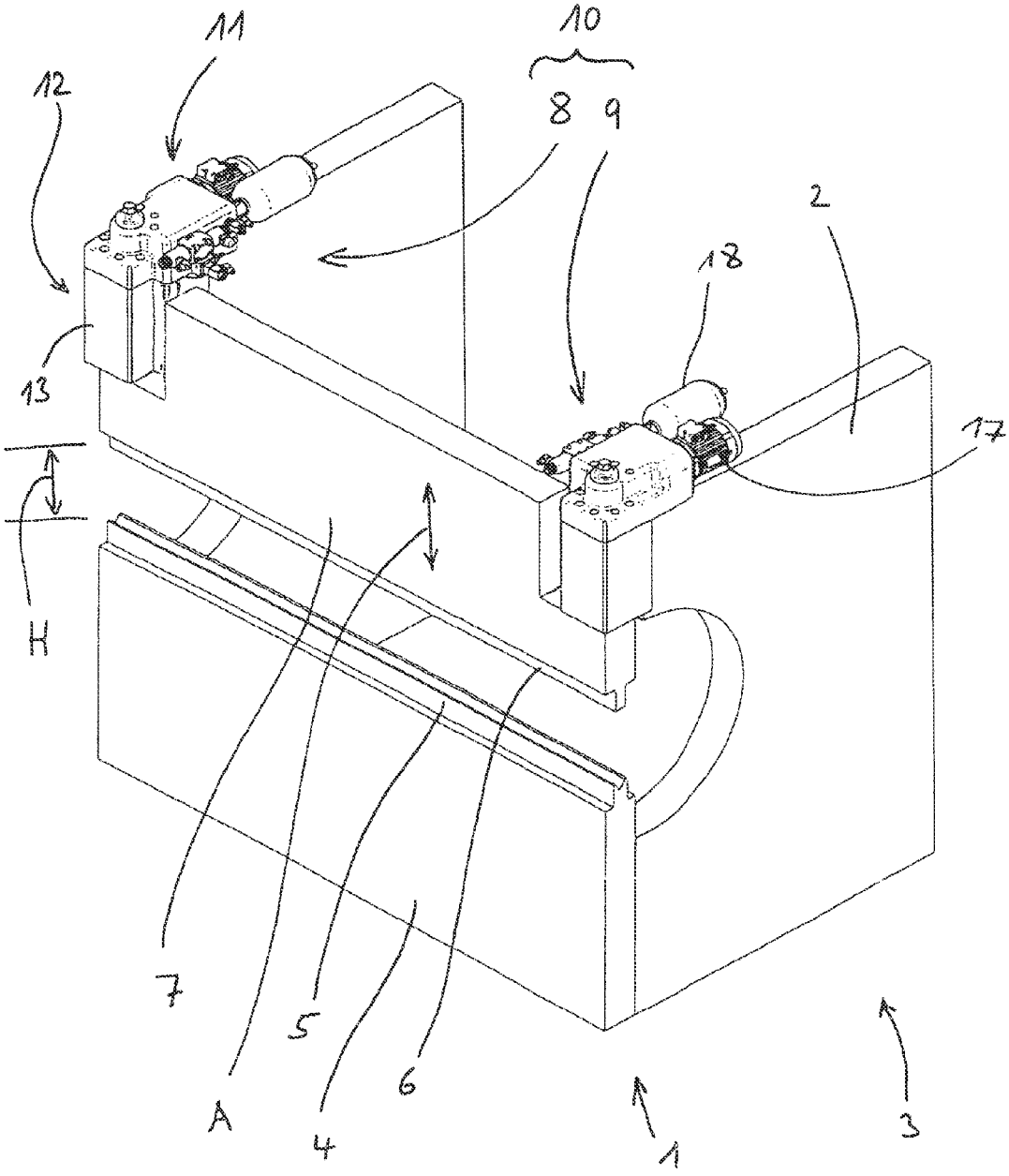
FIG. 1 schematically, a first machine press according to the present invention, structured as a press brake, FIG. 2 schematically, a second machine press according to the present invention, structured as a press brake, and FIG. 3 using a hydraulic schematic, the implementation of one of the two hydraulic drive units of the press brakes according to FIGS. 1 and 2.

The machine press 1 shown in FIG. 1, structured as a press brake, has a machine framework 3 comprising two C-frames 2. In a fixed spatial relationship with the machine framework 3, namely fixed in place on the lower profile shank of the two C-frames 2, in each instance, a lower tool support 4 with a lower tool 5 is disposed on the framework. An upper tool support 7, equipped with an upper tool 6, shown in its uppermost position in FIG. 1, can be moved linearly up and down relative to the lower tool support 4, by an operating stroke H. Because the press brake shown in FIG. 1 corresponds to the state of the art to this extent, which state of the art is sufficiently known, no further explanations are required in this regard.

In order to bring about the downward-directed movement of the upper tool support, a hydraulic drive system is provided. This comprises two hydraulic drive units, namely a left hydraulic drive unit 8 and a right hydraulic drive unit 9, which jointly form the hydraulic drive system 10 that acts on the upper tool support 7. The two hydraulic drive units 8 and 9 are sealed off and autarchic, i.e. they have no hydraulic connection whatsoever with one another. They are structured in the form of complete drives 11.

Figure 2:
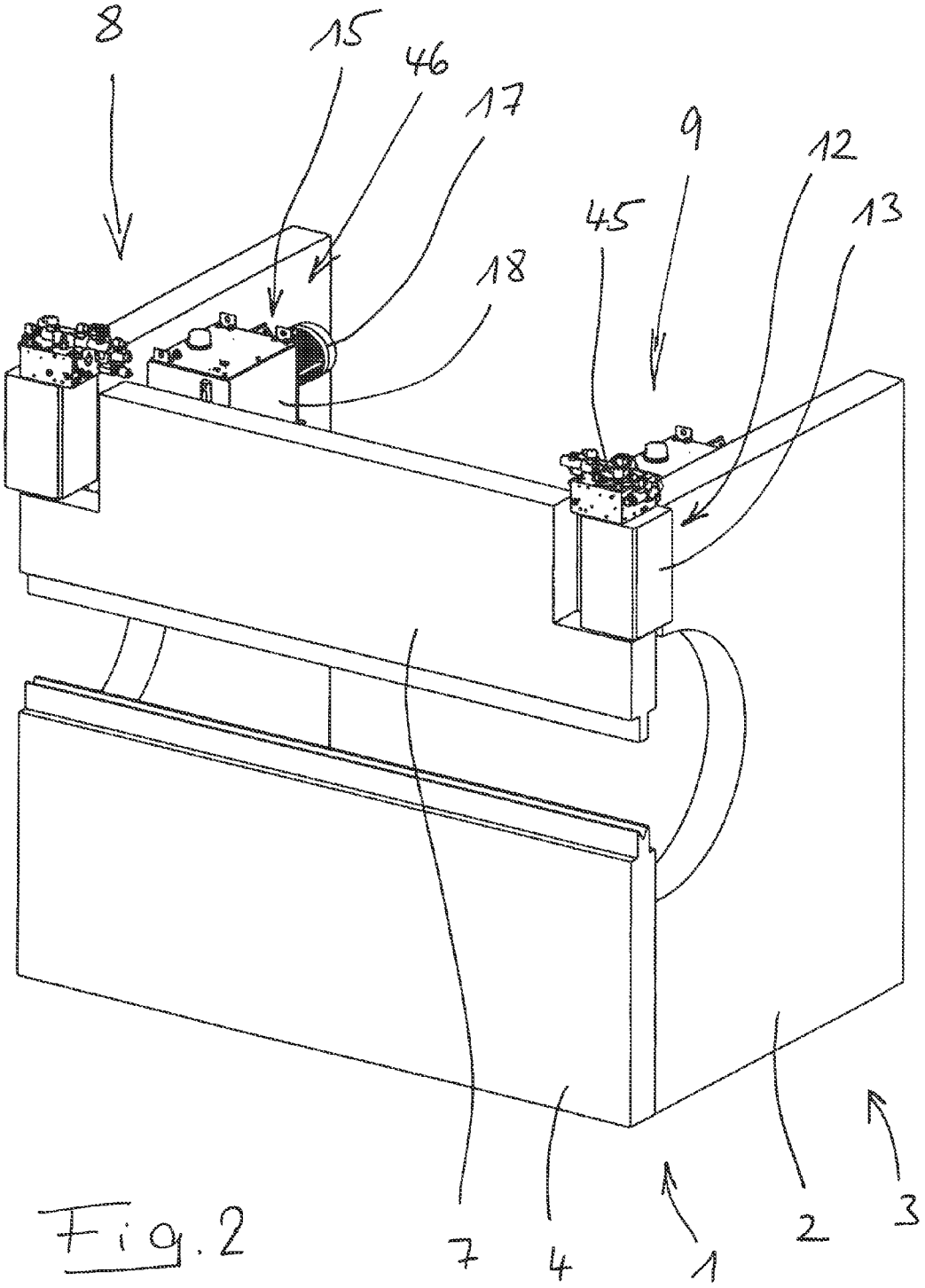

The press brake shown in FIG. 2 corresponds, with regard to essential design characteristics, to that according to FIG. 1, so that reference is made to the above explanations. Here, however, the two hydraulic drive units 8 and 9 are not structured as a complete drive solution that forms a structural unit, in each instance, but rather with a separate construction. Therefore, here the hydraulic piston/cylinder unit 12, in each instance, with the valve block 45 flanged onto the cylinder 13 in question, is spatially separated from the related module 46 that comprises the tank and the motor/pump unit 15 flanged onto the latter.

Each of the two complete drives 11 (FIG. 1)—structured as a mirror image —or each of the two hydraulic drives 8 and 9 (FIG. 2)—also structured as a mirror image —particularly comprises (see also the hydraulic schematic according to FIG. 3) a hydraulic piston/cylinder unit ("hydraulic cylinder") 12 structured as a differential cylinder, having a cylinder 13 and a piston 14 guided within it, the piston rod of which is firmly connected with the upper tool support 7, a hydraulic assembly 15 that acts on the hydraulic cylinder 12, with a hydraulic pump 16 structured as a constant pump having a direction of rotation, which pump is driven by an electric motor 17 structured as a frequency-regulated asynchronous motor (without feedback), and a tank 18 that contains the supply of hydraulic oil. The speed of rotation of the motor 17 and thereby its conveyance amount of the pump 16 can be adjusted by way of the machine control 21, as a function of the phase, for which purpose a speed-of-rotation profile is stored in the memory of the numeric machine control 21.

Activation of the hydraulic cylinder 12 by means of the hydraulic assembly 15 for the purpose of downward movement ("lowering") or upward movement ("lifting") of the upper tool support 7 takes place by way of a usual filter unit 19, a main pressure line 20, and a proportional 4/3-way valve 22 controlled by the numeric machine control 21. The latter valve is equipped with a position switch 23, which in turn feeds the actual position of the valve 22 back to the machine control 21, The three positions of the valve 22 correspond to the operating states "holding" (as shown in FIG. 2), "lowering," and "lifting." In the "lowering" position, the main pressure line 20 is connected with the piston work space 24, which represents the lowering work space, in this regard; in the "lifting" position, on the other hand, it is connected with the piston rod work space 25 that forms the lifting work space, whereby in this "lifting" position, the piston work space 24 (also; see below) is connected with the tank 18 by way of the valve 22.

Two further valves 26 and 27 are switched between the piston rod work space 25 and the valve 22, parallel to one another, which have different actions in the "lowering" position of the valve 22, depending on the work phase ("rapid lowering" or "force-pressing"; see below). For lowering of the upper tool support 7 in rapid lowering, in which the upper tool support 7 approaches the lower tool support 4 comparatively rapidly, because of its inherent weight, and the feeder valve 28 is open in order to fill the piston work space 24, which is increasing in size, from the tank 18, the seat valve 26 with integrated kick-back valve is also open, whereby the speed of the downward movement of the upper tool support 7 is controlled by way of the proportional valve 22. In this connection, opening of the (hydraulically activated) feeder valve is brought about, by way of the control line 31, by the pilot valve 29, which is connected with the main pressure line 20, controlled by the machine control 21, and equipped with a position switch 30.

Before the upper tool 6 reaches the work piece, the downward movement of the upper tool support 7 is braked in rapid lowering—by means of corresponding control of the valve 22. A switch to force-pressing takes place, in that not only the seat valve 26 but also the feeder valve 28 is closed—by means of corresponding switching of the pilot valve 29—so that the piston work space 24 has hydraulic fluid applied to it by way of the main pressure line 20, the valve 22, and the line 32, for force-pressing, in controlled manner. The back-pressure valve 27 switched between the piston rod work space 25 and the valve 22 prevents uncontrolled lowering of the upper tool support 7 during force-pressing, in that it is set to such a holding pressure that only active application of hydraulic fluid to the piston work space 24, from the main pressure line, at a pressure above the pressure prevailing in the tank 18, brings about lowering of the upper tool support 7.

At the end of force-pressing, i.e. at the end of the lowering movement, the valve 22 is switched to "lifting." In this connection, what is called "decompression" takes place first, in order to reduce the high pressure in the piston work spaces 24, in controlled manner, whereby the said pressure reduction in the phase of decompression is also accompanied by the reduction of possible deformations of the machine structure that might have occurred during force-pressing. Typically, the decompression phase includes controlled upward movement of the upper tool support 7 over a predetermined path at a (slow) working speed, by means of corresponding application of fluid to the lifting work spaces 25 of the two hydraulic drive units 8 and 9. Subsequently, the piston rod work space 25 has hydraulic fluid applied to it by way of the valve 22 and the line 33 (with the seat valve 26 being open or the kick-back valve of the seat valve 26 being open), from the main pressure line 20, whereby the increased speed of the upward movement of the upper tool support 7 is controlled by way of the proportional function of the valve 22. The hydraulic fluid displaced from the piston work space 24 in this connection gets into the tank 18 by way of the feeder valve 28, which is now open once again.

The pressure that exists in the main pressure line 20 is not only controlled during the work cycle, by means of a complex pressure-limiting unit, but also regulated. as a function of load, whereby the load-dependent regulation takes into consideration different demands on the at least two hydraulic drive units of the hydraulic drive system. For this purpose, a pressure limiter 34 switched between the main pressure line 20 and the tank. 18 is provided, on the one hand. This limiter comprises a known cartridge 35, the pressure threshold of which cartridge, at which threshold the connection between the main pressure line 20 and the tank 18 is opened, can be adjusted, by way of the pressure prevailing in a control line 36. The pressure prevailing in the control line 36 is limited by a pressure-limiting valve 37 switched between the control line 36 and the tank 18, the set value of which valve thereby predetermines the maximal pressure prevailing in the main pressure line 20. Lowering (by way of a phase-dependent pressure profile stored in the memory of the machine control) of the pressure level existing in the control line 36, controlled by way of the machine control 21, is possible by way of the adjustable pressure-limiting valve 38 that can be controlled by way of the machine control 21—switched in parallel to the pressure-limiting valve 37, in terms of flow technology. Such lowering of the pressure level in the control line 36 brings about a corresponding reduction in the pressure threshold at which a connection between the main pressure line 20 and the tank 18 is produced by way of the cartridge 35, and accordingly a (profile-controlled) adjustment of the maximal pressure that occurs in the main pressure line 20.

A hydraulic/mechanical pressure compensator 39 is switched in parallel, in terms of flow technology, to the pressure limiter 34, between the main pressure line 20 and the tank 18, which compensator in turn in the active phase of the pressure compensator 39—limits the maximal pressure that occurs in the main pressure line 20, specifically to a value that lies above the load pressure currently prevailing at the hydraulic cylinder 13, in each instance, by a predetermined measure ("margin"). For this purpose, the control input 40 of the pressure compensator 39 is connected with a shuttle valve 42, by way of the control line 41, which valve in turn switches the higher of the pressures applied at its two inputs, in each instance, to the control line 41. In this connection, the one input of the shuttle valve 42 stands in connection with the piston work space 24 or the line 32 connected with the latter; the other is connected with the line 33 assigned to the piston rod work space 25, into which the valves 26 and 27 are switched.

The pressure compensator 39 can be turned on and off, in controlled manner, by way of the machine control 21, in that the control line 31, by way of which the feeder valve 28 is switched over, is also switched to a second control input 43 of the pressure compensator 39. In this manner, the pressure compensator 39 is non-functional when the feeder valve 28 is open, i.e. a connection of the main pressure line 20 with the tank 18, by way of the pressure compensator 39, is excluded.

Figure 3:
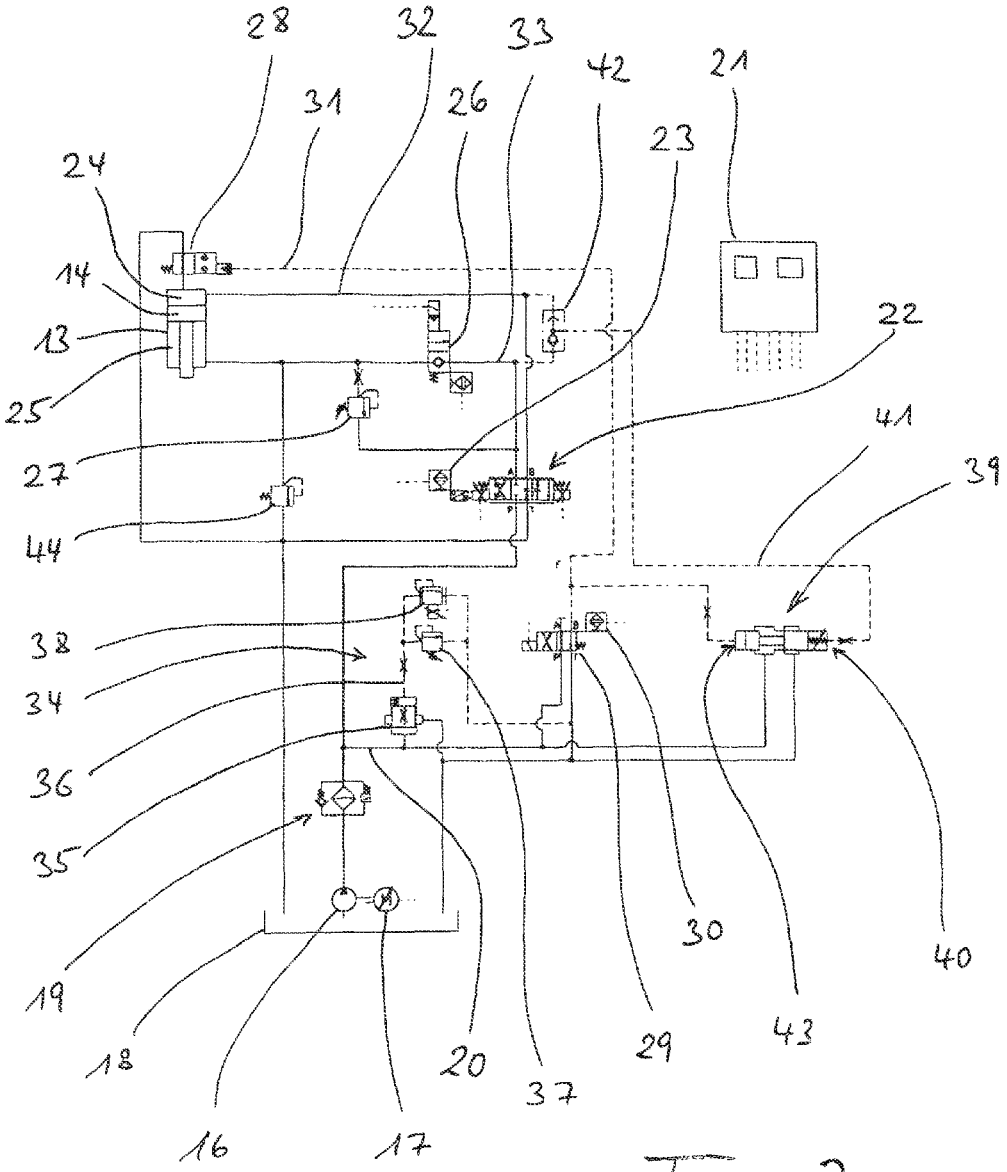

Furthermore, a safety valve structured as a pressure-limiting valve 44 is also provided in both hydraulic drive units structured in accordance with the schematic according to FIG. 3, in each instance, specifically between the piston rod work space 25 and the tank 18. This takes into consideration that during force-pressing, the hydraulic cylinder 13 acts as a pressure amplifier, and prevents serious damage to the hydraulic system in the event of a failure of the back-pressure valve 27.

According to the speed-of-rotation profile mentioned above, the motor 17 can come to a stop, for example during the phase of the downward movement of the upper tool support that takes place with rapid lowering, so that the pump 16 does not convey any hydraulic fluid at all. During force-pressing, the pump speed of rotation can be set to a value between 10% and 100% of the design speed of rotation, for example, as a function of the pressing task, in each instance, whereby the speed of rotation is set in such a manner that the conveyed amount determined by calculations for the movement progress of the upper tool support 7 is always exceeded by a safety margin (for example 5%). The reserve in question is regulated by way of the pressure-limiting unit explained above, and returned to the tank 18. For the phase of lifting of the upper tool support 7, the pump speed of rotation can even be increased beyond the design speed of rotation, for example to a value of 130% of the design speed of rotation, because less stress exists here (over a shorter period of time).

Solely for reasons of clarity of the drawing, the various control lines with which the numeric machine control 21 is connected with the components controlled by it or with the different setting switches were not drawn continuously, but rather only indicated at their two ends, in each instance. Furthermore, it should be pointed out that, as already explained above, a function having the same effect as the method of functioning of the pressure-limiting unit can also be implemented by way of a structural unit having superimposed functionalities of pressure limitation (in the main pressure line, in each instance) according to a phase-dependent pressure profile, on the one hand, and according to load dependence, on the other hand.

What is claimed is:

1. A machine press (1) comprising a machine framework (3), a lower tool support (4), an upper tool support (7), which can be moved linearly up and down relative to the lower tool support, by means of a hydraulic drive system, by an operating stroke (H), and a numeric machine control (21), wherein the machine press furthermore has the following characteristics:

the hydraulic drive system comprises at least two hydraulic drive units (8, 9) that are independent of one another, wherein each of the hydraulic drive units in turn has the following characteristics:

at least one hydraulic cylinder (12) brings about the linear up and down movement of the upper tool support (7) and is connected, by way of valves (22, 26, 27) and a main pressure line (20) that stands under a supply pressure, with a pump (16) driven by a motor (17), which pump draws hydraulic fluid from a tank (18);

a speed of rotation of the motor (17) is adjustable by way of the numeric machine control (21), wherein a speed-of-rotation profile defined over a work cycle is stored in a memory of the numeric machine control;

a pressure-limiting unit limits the level of the supply pressure at least during a part of the work cycle, to a lower pressure of a pressure stored in the memory of the numeric machine control (21), defined over the work cycle, and an actual load pressure at the at least one hydraulic cylinder (12), increased by a margin.

2. The machine press of claim 1, wherein the pressure-limiting unit has a pressure limiter (34) that can be controlled by the numeric machine control, and a separate, hydraulic/mechanical pressure compensator (39), switched in parallel to it, in terms of flow technology.

3. The machine press of claim 2, wherein the load pressure that occurs at the at least one hydraulic cylinder (12) at a lifting work space (25) and at a lowering work space (24) is tapped by means of a shuttle valve (42), and the higher of two pressure values is passed to a control input (40) of the pressure compensator (39).

4. The machine press of claim 2, wherein a pilot valve (29) that can be controlled by the machine control (21) is switched ahead of a second control input (43) of the pressure compensator (39), by means of which valve either the supply pressure or the tank pressure is applied to the second control input of the pressure compensator.

5. The machine press of claim 1, wherein the pressure-limiting unit comprises an electronic pressure compensator that can be controlled by means of the numeric machine control (21), integrated into a structural unit, having a pressure limiter that can be adjusted by means of the numeric machine control.

6. The machine press of claim 1, wherein the tank (18) is open and stands under atmospheric pressure.

7. The machine press of claim 1, wherein the pump (16) is a pump having a constant displacement volume, one conveying direction, and one direction of rotation.

8. The machine press of claim 1, wherein the motor (17) is a frequency-regulated asynchronous motor without feedback.

9. The machine press of claim 1, wherein the work cycle for which the speed-of-rotation profile and a pressure profile predetermine the speed of rotation of the motor (17) as a function of the phase, or the maximal supply pressure, comprises at least phases of rapid lowering, force-lowering, and lifting of the upper tool support (7).

10. The machine press of claim 9, wherein the motor (17) does not rotate during the phase of rapid lowering of the upper tool support (7), according to the speed-of-rotation profile.

11. The machine press of claim 9, wherein according to the speed-of-rotation profile, the motor speed of rotation in the phase of lifting of the upper tool support (7) exceeds the motor speed of rotation in the phase of force-lowering.

12. The machine press of claim 9, wherein the numeric control (21) comprises an input unit at which at least the speeds of rotation of the speed-of-rotation profile and the pressures of the pressure profile can be input.

13. The machine press of claim 1, wherein each hydraulic drive unit (8, 9) has precisely one hydraulic cylinder (12), configured as a differential cylinder.

14. The machine press of claim 13, wherein the differential cylinder has a surface area ratio of the lifting work space (25) to the lowering work space (24) of less than 0.1.

* * * * *